US009924849B2

(12) United States Patent
Gary, Jr. et al.

(10) Patent No.: US 9,924,849 B2
(45) Date of Patent: Mar. 27, 2018

(54) DISHWASHER WITH INTEGRATED CLOSURE ELEMENT HAVING AN ANTENNA

(71) Applicant: Whirlpool Corporation, Benton Harbor, MI (US)

(72) Inventors: Wyndham F. Gary, Jr., Whitefish Bay, WI (US); Blayne C. Smith, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 592 days.

(21) Appl. No.: 14/508,197

(22) Filed: Oct. 7, 2014

(65) Prior Publication Data

US 2016/0095493 A1 Apr. 7, 2016

(51) Int. Cl.

| | |
|---|---|
| ***A47L 15/00*** | (2006.01) |
| ***A47L 15/42*** | (2006.01) |
| ***A47L 15/46*** | (2006.01) |

(52) U.S. Cl.

CPC ..... *A47L 15/0063* (2013.01); *A47L 15/4257* (2013.01); *A47L 15/4274* (2013.01); *A47L 15/4293* (2013.01); *A47L 15/46* (2013.01); *A47L 15/0084* (2013.01)

(58) Field of Classification Search

CPC .. A47L 15/0063; A47L 15/46; A47L 15/4274; A47L 15/4293; A47L 15/4257; A47L 15/0084

See application file for complete search history.

(56) References Cited

U.S. PATENT DOCUMENTS

| | | | | |
|---|---|---|---|---|
| 6,456,242 | B1 | 9/2002 | Crawford | |
| 7,363,031 | B1 | 4/2008 | Aisa | |
| 7,383,644 | B2 | 6/2008 | Lyu et al. | |
| 8,526,935 | B2 | 9/2013 | Besore et al. | |
| 2002/0122006 | A1 | 9/2002 | Crawford | |
| 2009/0118848 | A1 | 5/2009 | Santinato et al. | |
| 2009/0298449 | A1 * | 12/2009 | Tylicki | G08B 1/08 455/128 |

(Continued)

FOREIGN PATENT DOCUMENTS

| | | | |
|---|---|---|---|
| CN | 202853254 | U | 4/2013 |
| CN | 103712406 | A | 4/2014 |

(Continued)

OTHER PUBLICATIONS

Machine Translation of EP 2700346 to Aicher, Feb. 2014.*
European Search Report for Counterpart EP15183498.3, dated Feb. 9, 2016.

*Primary Examiner* — Michael Barr
*Assistant Examiner* — Benjamin L Osterhout
(74) *Attorney, Agent, or Firm* — McGarry Bair PC

(57) ABSTRACT

A dishwasher with an integrated closure element, such as a pivoting door or sliding drawer front, having a metallic front panel extending from an upper edge to a lower edge of the closure element includes a user interface located on an upper face of the closure element such that when the closure element is in a closed position, the user interface faces upwardly and is inaccessible to a user. A radio system for the dishwasher includes an upwardly facing antenna located on the closure element adjacent the user interface.

10 Claims, 11 Drawing Sheets

(56) References Cited

U.S. PATENT DOCUMENTS

| | | | | |
|---|---|---|---|---|
| 2010/0182136 | A1* | 7/2010 | Pryor | G01F 23/292 340/425.5 |
| 2011/0137657 | A1 | 6/2011 | Cenedese et al. | |
| 2011/0140972 | A1 | 6/2011 | Besore et al. | |
| 2011/0153101 | A1* | 6/2011 | Thomas | G06Q 10/04 700/291 |
| 2011/0153109 | A1* | 6/2011 | Drake | H02J 3/14 700/296 |
| 2011/0202293 | A1* | 8/2011 | Kobraei | G06Q 50/06 702/62 |
| 2011/0222448 | A1 | 9/2011 | Ofek et al. | |
| 2011/0226808 | A1 | 9/2011 | Lonski | |
| 2012/0209446 | A1* | 8/2012 | Poyner | H04L 12/2825 700/297 |
| 2013/0066479 | A1* | 3/2013 | Shetty | G01D 4/002 700/295 |
| 2013/0125937 | A1 | 5/2013 | Baldwin et al. | |
| 2014/0139381 | A1 | 5/2014 | Sippel | |
| 2014/0174468 | A1 | 6/2014 | Cottrell et al. | |
| 2014/0174489 | A1 | 6/2014 | Cottrell et al. | |

FOREIGN PATENT DOCUMENTS

| | | | |
|---|---|---|---|
| EP | 2302122 | A1 | 3/2011 |
| EP | 2339057 | A1 | 6/2011 |
| EP | 2700346 | A2 | 2/2014 |
| WO | 2013098330 | A2 | 7/2013 |

* cited by examiner

DISHWASHER WITH INTEGRATED CLOSURE ELEMENT HAVING AN ANTENNA

BACKGROUND

Dishwashers include a treating chamber in which dishes are placed to be washed according to an automatic cycle of operation. Users are increasingly interested in remote communication with home appliances, including dishwashers, in order to efficiently manage usage of the appliance. It is known to provide a dishwasher with an antenna to facilitate remote communication. Providing a dishwasher with an antenna is challenging because most dishwashers are primarily constructed of metal that is electrically connected to earth ground and acts as a large Faraday shield that does not allow wireless signals to escape the dishwasher. In addition, dishwashers having a door with a metallic front panel that covers the entire front surface of the door are becoming highly desirable because of their sleek, clean, high-end appearance, but such doors serve as large Faraday shields, thus further complicating antenna location for the dishwasher.

SUMMARY

A dishwasher according to one embodiment for treating dishes according to at least one automatic cycle of operation comprises a housing; a tub at least partially defining an open-faced treating chamber within the housing for receiving dishes for treatment according to the at least one automatic cycle of operation; a closure element movable to selectively close the open face of the treating chamber, the closure element including a metallic front panel extending from an upper edge of the closure element to a lower edge of the closure element and a control console located at an upper end of the closure element behind the front panel; a user interface associated with the console and located on an upper face of the closure element such that when the closure element closes the open face of the treating chamber, the user interface faces upwardly and is inaccessible to a user; and an antenna located within the control console adjacent the user interface.

DESCRIPTION OF EMBODIMENTS OF THE INVENTION

Figure 1:
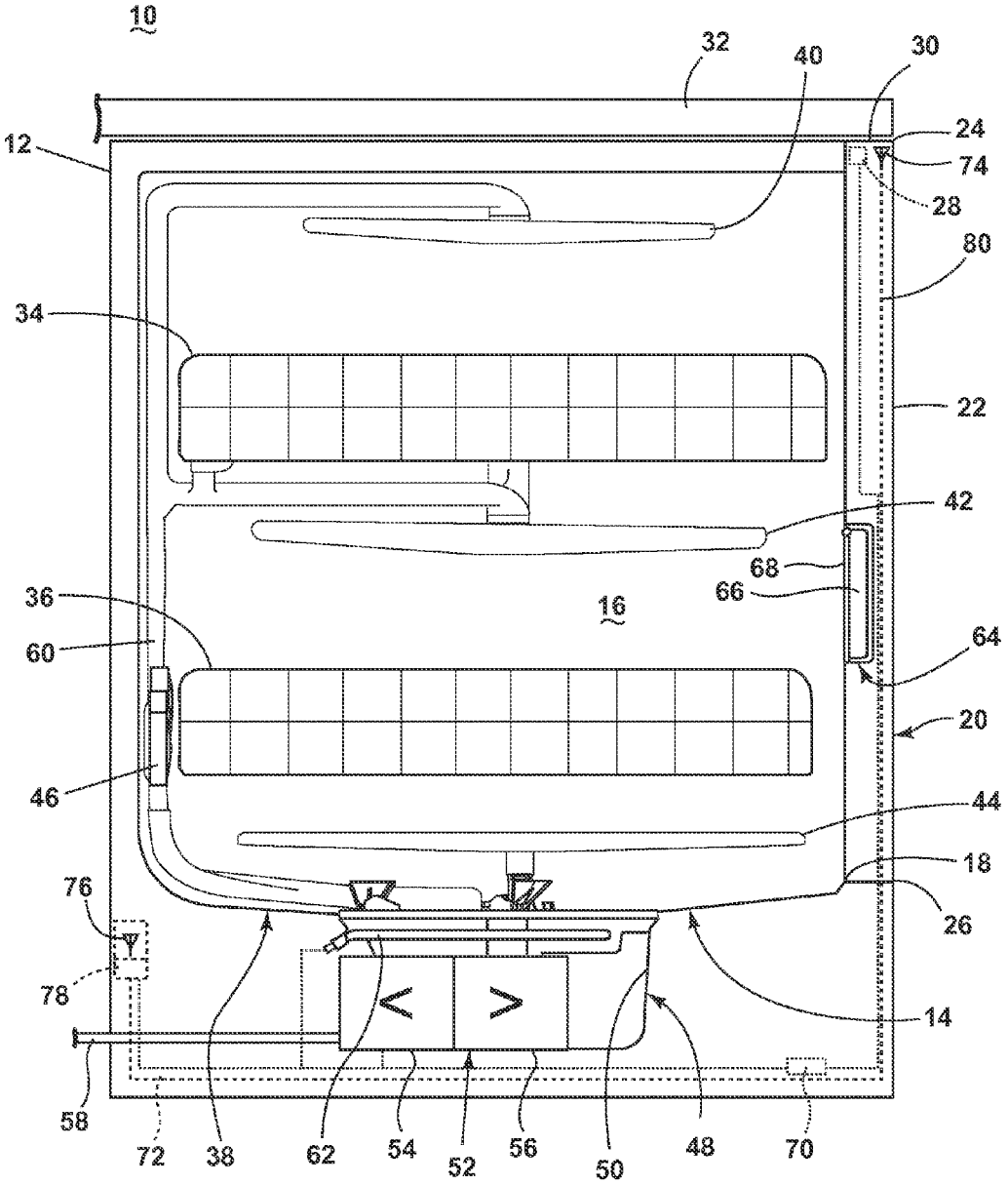
FIG. 1 is a schematic illustration of an automatic dishwasher according to an embodiment of the invention.

In FIG. 1, an automated dishwasher 10 according to a first embodiment is schematically illustrated. The dishwasher 10 can treat dishes according to an automatic cycle of operation. The dishwasher 10 shares many features of a conventional automated dishwasher, which will not be described in detail herein except as necessary for a complete understanding of the invention. While the present invention is described in terms of a conventional dishwashing unit, it could also be implemented in other types of dishwashing units, such as in-sink dishwashers, multi tub dishwashers, or drawer-type dishwashers.

The dishwasher 10 has a housing, which may include a cabinet or chassis 12 that may define an interior of the dishwasher 10. Depending on whether the dishwasher 10 is a stand-alone or built-in, the housing of the dishwasher 10 may be a chassis/frame with or without panels attached, respectively. An open-faced tub 14 may be mounted to the dishwasher housing and provided within the chassis 12, and may at least partially define a treating chamber 16, having an open face 18 defining an access opening, for receiving dishes for treatment.

A closure element 20 may be movably mounted to the dishwasher 10 for movement between opened and closed positions to selectively open and close the open face 18 of the treating chamber 16. Thus, the closure element 20 provides accessibility to the treating chamber 16 for the loading and unloading of dishes or other treatable items. When the closure element 20 is closed, user access to the treating chamber 16 may be prevented, whereas user access to the treating chamber 16 may be permitted when the closure element 20 is open. The closure element 20 is shown by example in the present embodiment as a door mounted at its lower end, such as by a hinge mounting, for pivoting movement relative to the tub 14, whose open face 18 faces forwardly. Alternatively, the tub 14 may be slidable relative to the chassis 12 with the treating chamber open face 18 facing upwardly, as in a drawer-type dishwasher, and the closure element 20 may be slidable with the tub 14, such as by forming a portion of a drawer housing surrounding the tub 14 or being in the form of a drawer front attached to the front of the tub 14, so that opening and closing the closure element 20 moves the tub 14 relative to the chassis 12 to thereby provide or prevent, respectively, access to the treating chamber open face 18, as will be described in a later embodiment in more detail.

The closure element 20 may include a front panel 22 that extends from at or near an upper edge 24 of the closure element 20 to at or near a lower edge 26 of a closure element 20 so as to cover substantially the entire front face of the closure element 20, with the possible exception of one or more apertures to accommodate elements on the closure element 20, such as, for example, a handle (not shown) to facilitate opening and closing the closure element 20, an illumination display (not shown) (e.g., a light for indicating an operational status of the dishwasher 10), and a window. The front panel 22 may be made of a metallic material, such as stainless steel, or other suitable materials. A user interface 28 may be supported by the closure element 20 so as to be located on or to form an upper face 30 of the closure element 20, facing upwardly when the closure element 20 is in a closed position. This type of closure element may be referred to as an integrated closure element or integrated door as the front panel 22 of the closure element 20 provides a clean, sleek appearance uninterrupted by a forward facing user interface so as to render the dishwasher more integrated with its surroundings, such as cabinetry. When the closure element 20 is in the closed position, shown in FIG. 1, the user interface 28, facing upwardly on the upper face 30, is effectively covered and hidden by a counter 32, or other structure located above the dishwasher 10, thus preventing full access to the user interface 28. Depending on the vertical spacing between the counter 32 and the upper face 30, a user may be able to touch a portion of the upper face 30, such as a front edge of the upper face 30, but, with the closure element 20 closed, the user cannot access the user interface 28 to fully interact with the user interface 28 (i.e., selecting buttons, viewing a display, etc.) as can be done when the closure element 20 is opened. The counter 32 physically blocks the user from the user interface 28, or at least a significant portion of the user interface 28, and renders the user interface 28 inaccessible. A user can fully view and access the user interface 28 by opening the closure element 20, thereby moving the closure element 20 away from the counter 32.

Dish holders, illustrated in the form of upper and lower dish racks 34, 36, respectively, are located within the treating chamber 16 and receive dishes for washing. The upper and lower racks 34, 36 are typically mounted for slidable movement in and out of the treating chamber 16 for ease of loading and unloading. Other dish holders may be provided, such as a silverware or utensil basket. As used in this description, the term "dish(es)" is intended to be generic to any item, single or plural, that may be treated in the dishwasher 10, including, without limitation, dishes, plates, pots, bowls, pans, glassware, and silverware. While not shown, additional dish holders, such as a silverware basket on the interior of the closure element 20 or a third level rack above the upper rack 34, may also be provided.

A spraying system 38 may be provided for spraying liquid into the treating chamber 16 and is illustrated as having multiple sprayers in the form of an upper sprayer 40, a mid-level sprayer 42, a lower rotatable sprayer 44, and a spray manifold 46. The upper sprayer 40 may be located above the upper rack 34 and is illustrated as a rotatable spray arm that sprays liquid downwardly within the treating chamber 16. Mid-level rotatable sprayer 42 and lower rotatable sprayer 44 are located, respectively, beneath upper rack 34 and lower rack 36 and are illustrated as rotating spray arms. The mid-level sprayer 42 may provide a liquid spray upwardly through the bottom of the upper rack 34. The lower rotatable sprayer 44 may provide a liquid spray upwardly through the bottom of the lower rack 36. The mid-level rotatable sprayer 42 may optionally also provide a liquid spray downwardly onto the lower rack 36, but for purposes of simplification, this will not be illustrated herein. The spray manifold 46 may be fixedly mounted to the tub 14 adjacent to the lower rack 36 and may provide a liquid spray laterally through a side of the lower rack 36. The spray manifold 46 may not be limited to this position; rather, the spray manifold 46 may be located in virtually any part of the treating chamber 16. While not illustrated herein, the spray manifold 46 may include multiple spray nozzles having apertures configured to spray wash liquid towards the lower rack 36. The spray nozzles may be fixed or rotatable with respect to the tub 14.

A liquid recirculation system 48 may be provided for recirculating liquid from the treating chamber 16 to the spraying system 38. The recirculation system 48 may include a sump 50 and a pump assembly 52. The sump 50 collects liquid sprayed in the treating chamber 16 and may be formed by a sloped or recessed portion of a bottom wall of the tub 14. The pump assembly 52 may include both a drain pump 54 and a recirculation pump 56. The drain pump 54 may draw liquid from the sump 50 and pump the liquid out of the dishwasher 10 to a household drain line 58. The recirculation pump 56 may draw liquid from the sump 50 and pump the liquid to the spraying system 38 to supply liquid into the treating chamber 16. While the pump assembly 52 is illustrated as having separate drain and recirculation pumps 54, 56 in an alternative embodiment, the pump assembly 52 may include a single pump configured to selectively supply wash liquid to either the spraying system 38 or the drain line 58, such as by configuring the single pump to rotate in opposite directions, or by providing a suitable valve system. Though not shown, a liquid supply system may be fluidly coupled with the recirculation system 48 and may include a water supply conduit coupled with a household water supply for supplying water to the treating chamber 16.

As shown herein, the recirculation pump 56 has an outlet conduit in fluid communication with the spraying system 38 for discharging wash liquid from the recirculation pump 56 to the sprayers 40, 42, 44, 46. As illustrated, liquid may be supplied to the spray manifold 46, the mid-level rotatable sprayer 42, and the upper sprayer 30 through a supply tube 60 that extends generally rearward from the recirculation pump 56 and upwardly along a rear wall of the tub 14. While the supply tube 60 ultimately supplies liquid to the spray manifold 46, the mid-level rotatable sprayer 42, and the upper sprayer 40, it may fluidly communicate with one or more manifold tubes that directly transport liquid to the spray manifold 46, the mid-level rotatable sprayer 42, and the upper sprayer 40. Further, diverters (not shown) may be provided within the spraying system such that liquid may be selectively supplied to each of the sprayers 40, 42, 44, 46. The sprayers 40, 42, 44, 46 spray water and/or treating chemistry onto the dish racks 34, 36 (and hence any dishes positioned thereon) to effect a recirculation of the liquid from the treating chamber 16 to the liquid spraying system 38 to define a recirculation flow path.

A heating system including a heater 62 may be located within or near the sump 50 for heating liquid contained in the sump 50. A filtering system (not shown) may be fluidly coupled with the recirculation flow path for filtering the recirculated liquid.

A dispensing system may be provided for storing and dispensing treating chemistry to the treating chamber 16. As shown herein, the dispensing system can include a dispenser 64 mounted on an inside surface of the closure element 20 such that the dispenser 64 is disposed in the treating chamber 16 when the closure element 20 is in the closed position. The dispenser 64 is configured to dispense treating chemistry to the dishes within the treating chamber 16. The dispenser 64 can have one or more compartments 66 closed by a door 68 on the inner surface of the closure element 20. The dispenser 64 can be a single use dispenser which holds a single dose of treating chemistry, a bulk dispenser that holds a bulk supply of treating chemistry and is adapted to dispense a dose of treating chemistry from the bulk supply during a cycle of operation, or a combination of both a single use and bulk dispenser. The dispenser 64 can further be configured to hold multiple different treating chemistries. For example, the dispenser 64 can have multiple compartments defining different chambers in which treating chemistries can be held. While shown as being disposed on the closure element 20, other locations of the dispenser 64 are possible.

A controller 70 may also be included in the dishwasher 10, which may be operably coupled with various controllable components of the dishwasher 10 to implement a cycle of operation. The controller 70 may be located beneath the tub 14 as illustrated, or it may alternatively be located elsewhere within the chassis 12 or within the closure element 20. The controller 70 may also be operably coupled with the user interface 28 or other control panel for receiving user-selected inputs and communicating information to the user. The user interface 28 may include operational controls such as dials, lights, switches, and displays enabling a user to input commands, such as a cycle of operation, to the controller 70, and receive information.

The dishwasher 10 may further include a radio system in communication with the controller 70 for the exchange of data between the controller 70 and an external device, such as a home router. The radio system may include multiple antennas for external communication. In many dishwashers, the tub 14 is made from metal. The metal tub 14 and the metallic front panel 22 on the closure element 20 are electrically connected to earth ground and act as large Faraday shields that do not allow wireless signals to escape the dishwasher 10. The dishwasher 10 may employ antenna diversity to improve the quality and strength of the wireless signal, and the multiple antennas of the dishwasher 10 may be located relative to the tub 14 and the closure element 20 such that signals from the antennas are least affected by the metal tub 14 and the metal front panel 22. Even if the dishwasher 10 is provided with a plastic tub 14, antenna coverage may still prove to be an issue if the dishwasher 10 is provided with the metal front panel 22, or if the dishwasher 10 is placed near a metal object, like another appliance.

In the embodiment shown herein, the radio system includes a first antenna 74 and a second antenna 76, with the first antenna 74 located in or on the closure element 20 and the second antenna located in or on the housing. The antennas 74, 76 may be spaced from one another and can be directional, such that a complete, substantially spherical coverage pattern is provided, with each antenna 74, 76 providing an area of coverage. The antennas 74, 76 may need to communicate with a wireless router within the home, and the location of the wireless router with respect to the dishwasher 10 can vary from home to home. Thus, if the wireless router is somewhere within a first coverage area provided by the first antenna 74, the first antenna 74 alone may be able to communicate with the wireless router. Likewise, if the wireless router is somewhere within a second coverage area provided by the second antenna 76, the second antenna 76 alone may be able to communicate with the wireless router.

The number and location of the antennas can be varied in order to achieve a desired coverage pattern and may depend on factors such as the materials used to construct the dishwasher 10 and the environment in which the dishwasher will be located. For example, a dishwasher having a plastic tub rather than a metal tub may still experience antenna coverage issues if it is placed next to a metal object, such as another appliance like a refrigerator. In one example, one or both of the antennas 74, 76 can be a straight F-antenna, a slot antenna, a PIFA ("planar inverted-F antenna"), or a PESA ("passive electronically scanned antenna"), although other types of antennas may be usable as well.

In the illustrated embodiment, the first antenna is provided on or within the closure element 20 and is referred to herein as a front antenna 74. Because the closure element front panel 22 is metallic and hinders signal transmission forwardly of the dishwasher 10, the front antenna 74 is located proximate the closure element upper face 30 adjacent the user interface 28, facing upwardly when the closure element 20 is in the closed position. The second antenna is provided on or located proximate to a rear of the dishwasher 10, and is referred to herein as a rear antenna 76. A rear wall of the tub 14 or a rear portion of the chassis 12 may define the rear of the dishwasher 10. In the illustrated embodiment, the rear antenna 76 is mounted below the tub 14 in the rear of the dishwasher 10 (i.e., a lower rear side of the dishwasher 10) and can be mounted to an exterior or interior surface of the chassis 12, the tub 14, the frame (not shown), or panels mounted to the frame.

The radio system can further include one or more communication modules which operably couples the front and rear antennas 74, 76 to the controller 70. As illustrated, the front and rear antennas 74, 76 are operably coupled with a common communication module, which may include a radio 78, which is in turn operably coupled with the controller 70. The radio 78 provides an interface between the appliance controller 70 and an external network and can comprise a Wi-Fi radio module. In the illustrated embodiment, the rear antenna 76 is integrated into a printed circuit board (PCB) of the Wi-Fi radio module, and a cable 80 connects the front antenna 74 to the radio 78. In one example, the cable 80 can be a coaxial cable, although other types of cables, connections or wiring may be usable as well. While only the single radio 78 is shown herein, each of the antennas 74, 76 can be coupled with a separate radio, and the rear antenna 76 can be separate from the radio 78 rather than being integrated with the PCB for the radio 78.

Figure 2:
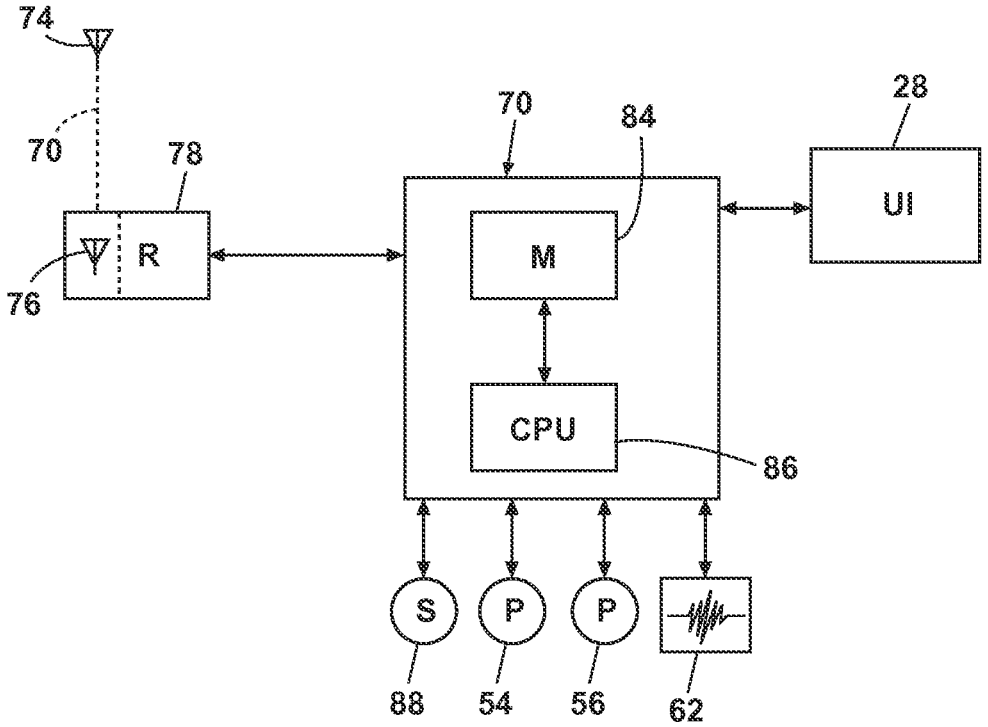
FIG. 2 is a schematic view of a controller of the dishwasher of FIG. 1.

As illustrated schematically in FIG. 2, the controller 70 may be coupled with at least one controllable component configured to implement an automatic cycle of operation, non-limiting examples of which include the heater 62 for heating the wash liquid during a cycle of operation, the drain pump 54 for draining liquid from the treating chamber 16, and the recirculation pump 56 for recirculating the wash liquid during a cycle of operation. The controller 70 may be provided with a memory 84 and a central processing unit (CPU) 86. The memory 84 may be used for storing control software that may be executed by the CPU 86 in completing a cycle of operation using the dishwasher 10 and any additional software. For example, the memory 84 may store one or more pre-programmed cycles of operation that may be selected by a user and completed by the dishwasher 10. The controller 70 may also receive input from one or more sensors 88. Non-limiting examples of sensors that may be communicably coupled with the controller 70 include a temperature sensor and a turbidity sensor to determine the soil load associated with a selected grouping of dishes, such as the dishes associated with a particular area of the treating chamber. The controller 70 may also be coupled with the radio 78 for transmitting and receiving data to and from the antennas 74, 76 via the radio 78.

Figure 3:
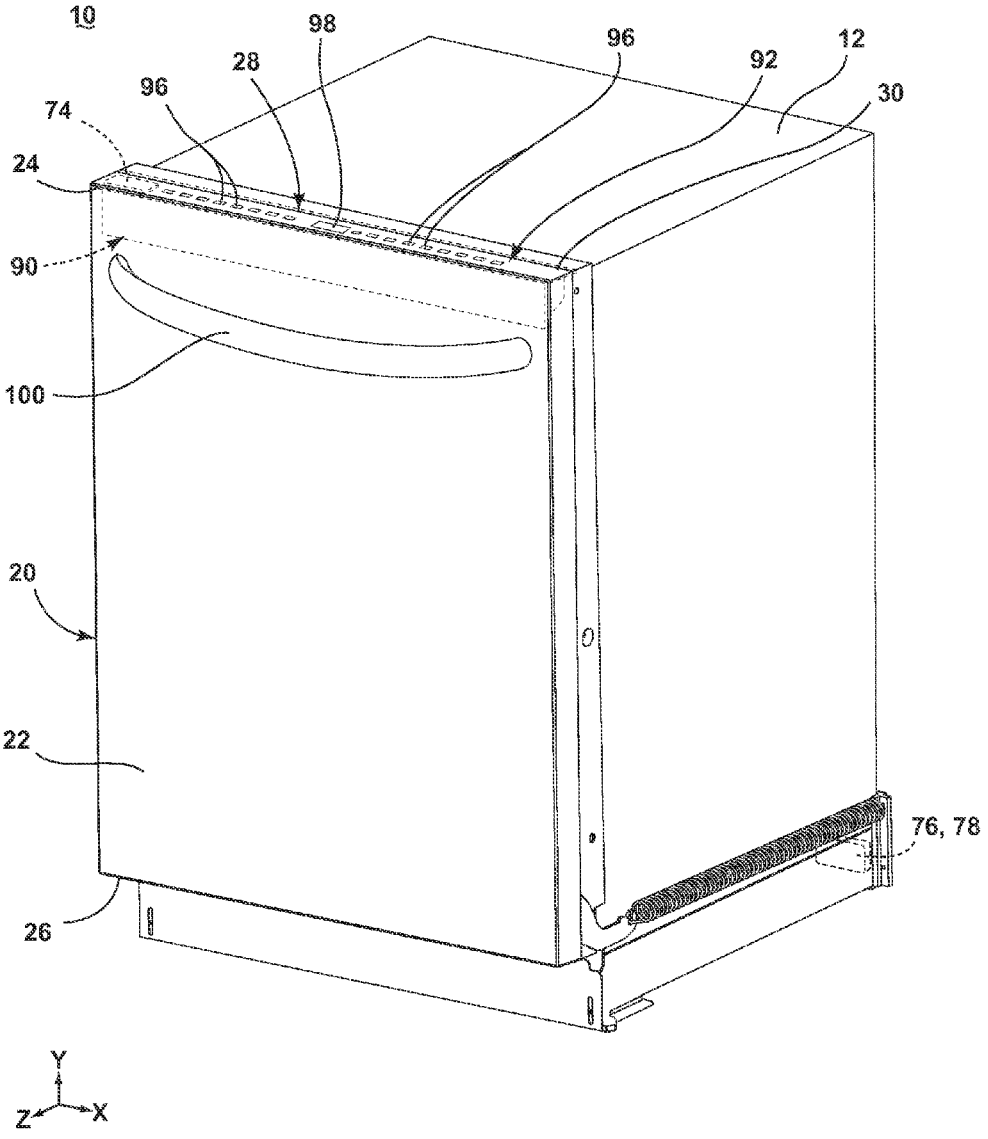
FIG. 3 is a perspective view of a dishwasher according to another embodiment of the invention, illustrating a control console on a closure element of the dishwasher and a front antenna mounted within the control console.

FIG. 3 is a perspective view of a dishwasher 10 according to a second embodiment of the invention. The dishwasher 10 can include many of the same elements disclosed for the schematic embodiment shown in FIGS. 1 and 2, and like elements will be referred to with the same reference numerals for both embodiments. The dishwasher 10 includes a control console 90 located at an upper end of the closure element 20 behind the front panel 22 that extends from at or near the upper edge 24 to at or near the lower edge 26 of the closure element 20. The control console 90 can include a top plate 92 that forms the upper face 30 of the closure element 20 and also forms part of the user interface 28. The user interface 28 can include operational controls such as capacitive switches 96 and a display 98, among other possible configurations including various combinations of dials, lights, switches, and displays enabling a user to input commands and receive information. The closure element 20 can also include a handle 100, as mentioned above, attached to the front panel 22.

Figure 4:
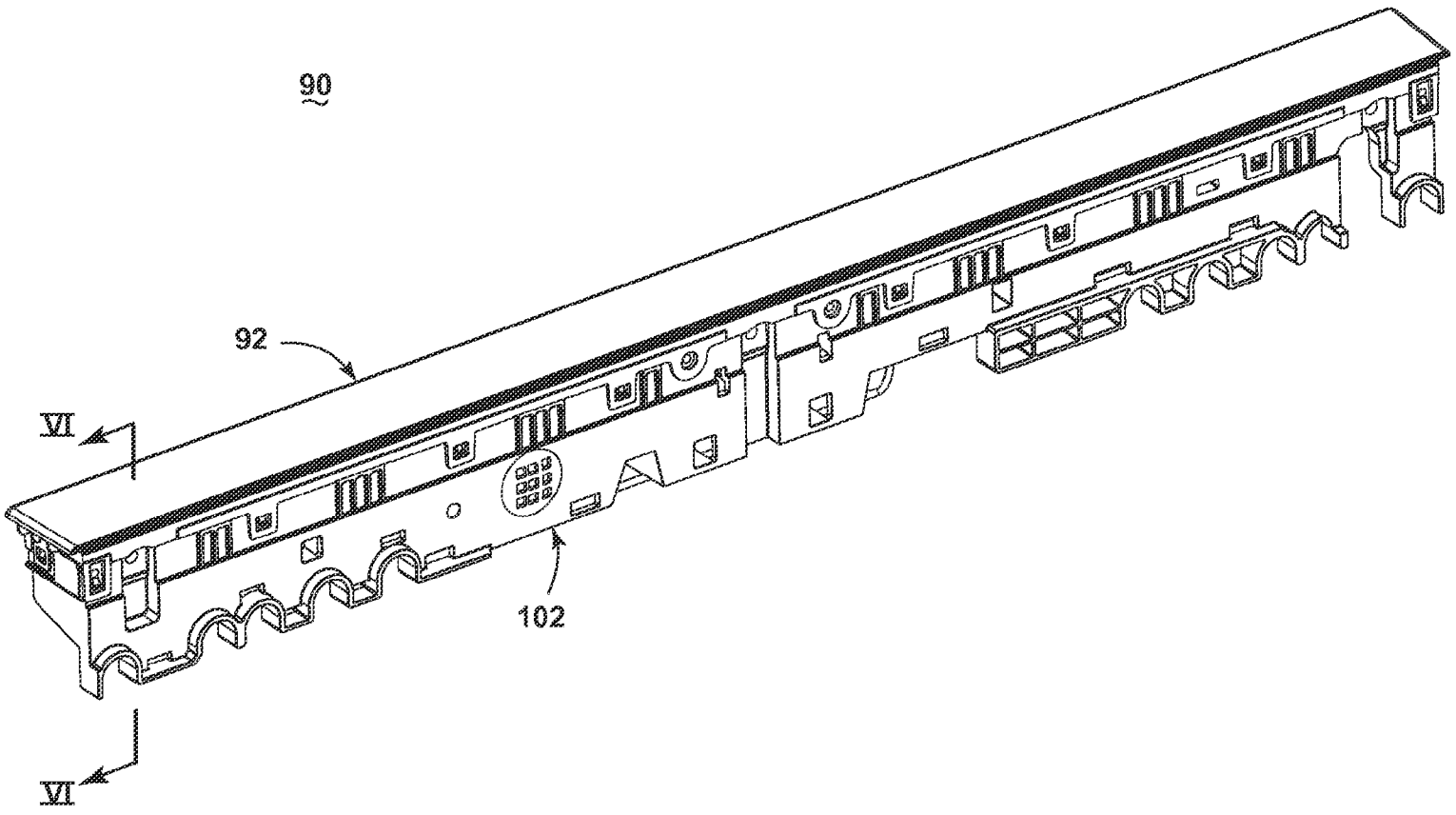
FIG. 4 is a front perspective view of a control console of the dishwasher of FIG. 3.
Figure 5:
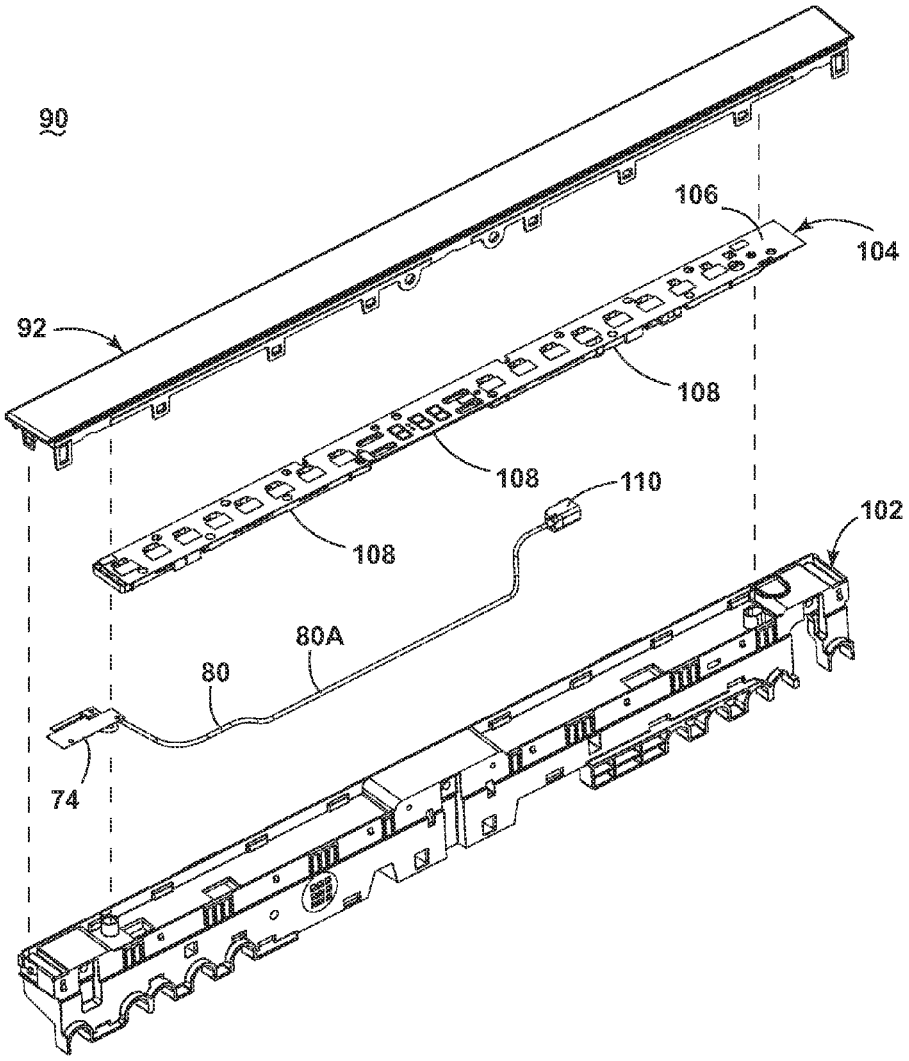
FIG. 5 is an exploded view of the control console of FIG. 4.

FIG. 4 is a front perspective view of the control console 90 of FIG. 3. The top plate 92 that forms the upper face 30 of the closure element 20 is mounted to a console body 102. As seen in the exploded view of the control console 90 in FIG. 5, the console body 102 supports the top plate 92 with a user interface printed circuit board (PCB) assembly 104 sandwiched therebetween. The top plate 92 is a generally planar body extending the width of the closure element 20 and including a plurality of depending tabs and other features to facilitate mounting the top plate 92 to the console body 102. Further, the top plate 92 is made of a non-metallic material, such as a polymer, through which wireless communication signals may pass. An exemplary polymeric material is the commercial DuraStar® copolyester DE1910HF. The console body 102 may also be made of a polymeric material and may be configured with features that mate with the tabs on the top plate 92 for mounting the top plate 92 to the console body 102. The PCB assembly 104 positioned between the top plate 92 and the console body 102 includes a PCB 106 and light cups 108 mounted to a lower side of the PCB 106 and may be coupled to the top plate 92, such as by heat staking, prior to mounting the top plate 92 to the console body 102. The front antenna 74 is also mounted between the top plate 92 and the console body 102 and is positioned adjacent the PCB assembly 104 at one end of the console body 102. The front antenna 74 can be secured in position in any suitable manner; in one example, the front antenna 74 can be heat staked to the top plate 92. Further, the front antenna 74 faces upwardly toward the top plate 92 and is shown as, for example, a straight F-antenna.

Figure 6:
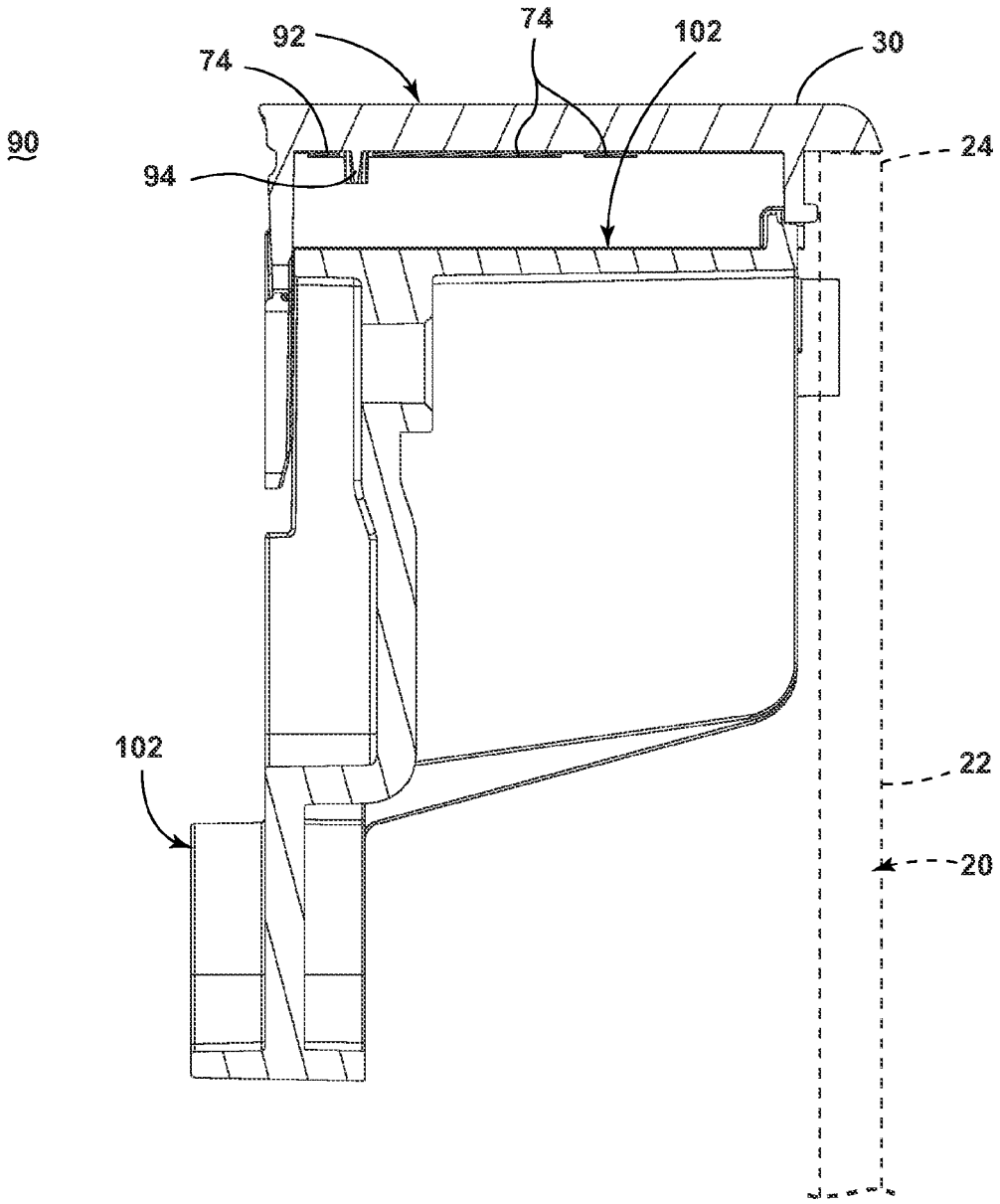
FIG. 6 is a sectional view taken along line VI-VI of FIG. 4.

FIG. 6 is a sectional view taken along line VI-VI of FIG. 4 showing the positioning of the front antenna 74 between the top plate 92 and the console body 102. The front antenna 74 may be disposed directly adjacent the lower surface of the top plate 92 such that the antenna 74 contacts the top plate 92 or spaced from the lower surface of the top plate 92 a distance that optimizes the performance of the front antenna 74. The particular spacing distance is a function of antenna type and the material(s) employed for the top plate 92 and is a balance between possible detuning of the antenna 74 if it is positioned too close to the top plate 92 and loss of range if the antenna 74 is too far below the top plate 92. In one example, it has been determined that the front antenna 74 in the form of the straight F-antenna performs best when spaced about 1 mm from the lower surface of the top plate 92 made of the above-mentioned polymeric material. FIG. 6 also shows an exemplary downwardly extending stud 94 on the top plate 92 for heat staking the front antenna 74 to the top plate 92.

In addition, the sectional view shows that the top plate 92 can overlie the upper edge of the closure element front panel 22 (shown schematically in phantom); alternatively, the top plate 92 can be terminate behind the upper edge of the front panel 22. Either of these configurations, or another configuration, is feasible for the formation of the upper edge 24 of the integrated closure element 20.

Figure 7:
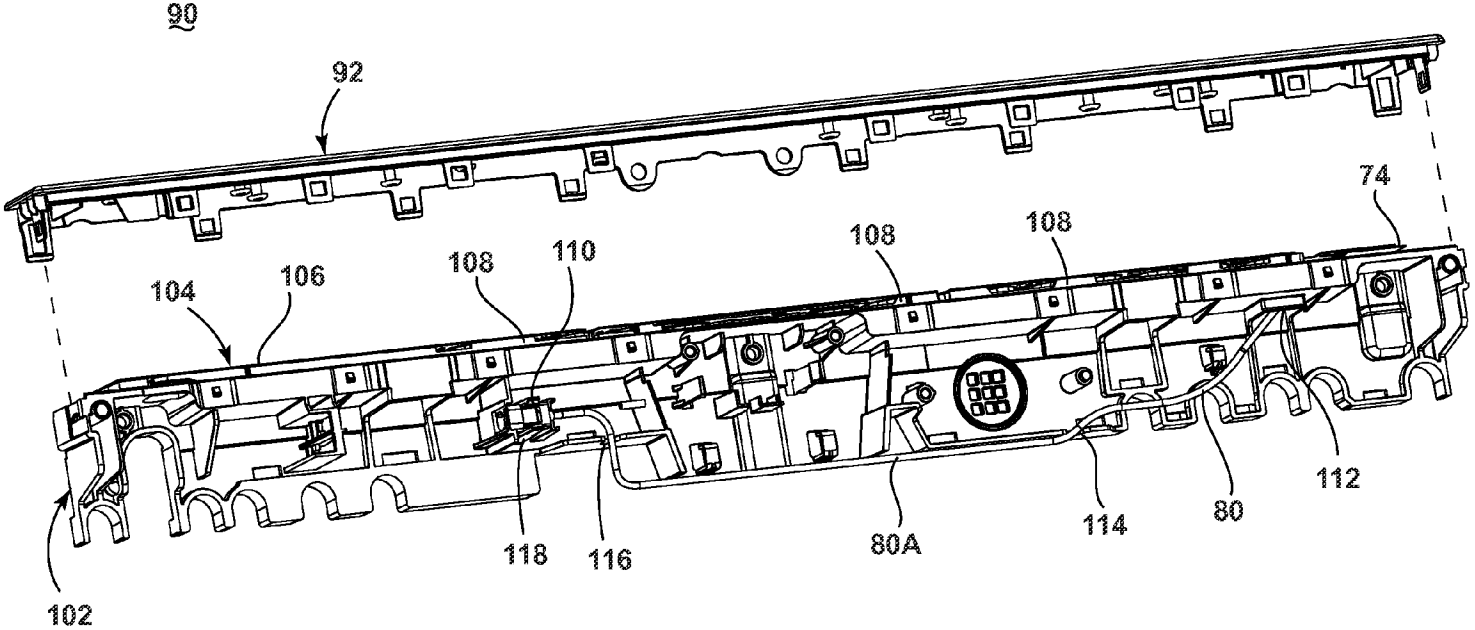
FIG. 7 is a rear perspective view of the control console of FIG. 4.

FIG. 7 is a rear perspective view of the control console of FIG. 3 with the top plate 92 exploded from the PCB assembly 104 and the console body 102. The cable 80 connecting the front antenna 74 to the radio 78 (FIG. 1) may be formed of multiple cable sections coupled together to accommodate the configuration of the dishwasher 10. One such cable section is a cable section 80A joining the front antenna 74 to a cable connector 110. The console body 102 may include one or more routing features to route the cable section 80A through the console body 102 and to secure the cable connector 110 to the console body 102. In particular, the cable section 80A extends from the front antenna 74, positioned on an upper side of the console body 102, downward through an aperture 112 formed in an upper surface of the console body 102, further downward through a first notch 114 on a lower surface of the console body 102, laterally along and below a lower surface of the console body 102, and upward through a second notch 116 to terminate at the cable connector 110 held in place by a connector support 118 on the rear side of the console body 102. The rest of the cable 80 (not shown in FIG. 6), which may be formed by one or more cable sections joined together by connectors, couples with the cable connector 110 and extends through the closure element 20 and within the chassis 12 under the tub 14 to the side of the dishwasher 10 opposite the closure element 20 for ultimately electronically coupling the first antenna 74 to the radio 78 (FIG. 1).

Figure 8:
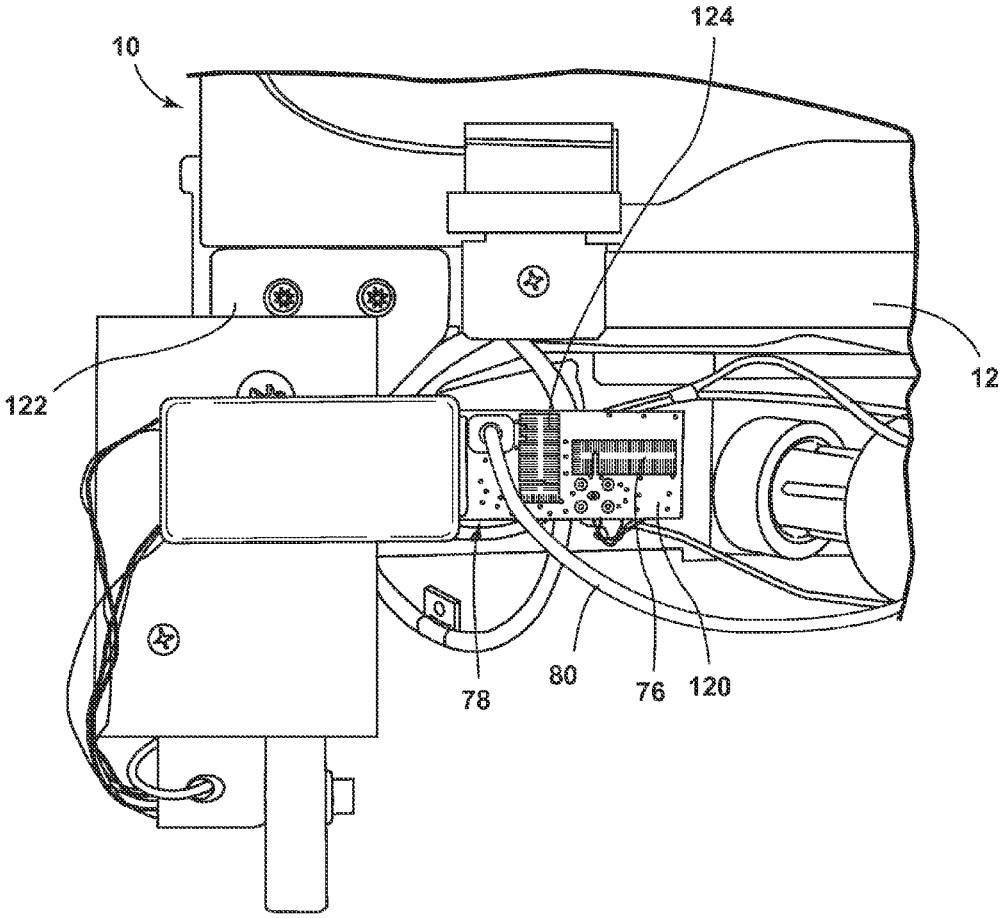
FIG. 8 is a rear view of a rear antenna on a radio module mounted to a rear side of the dishwasher of FIG. 3.

FIG. 8 is a rear view of a lower portion of the dishwasher 10 of FIG. 3 showing the radio 78 with the rear antenna 76 embedded on the radio PCB 120. The rear antenna 76 can be located on the rear side of the dishwasher 10, below the tub 14. As shown herein, in one configuration, the rear antenna 76 can be mounted to a frame 122 that rests on a ground surface and supports the tub 14 on the ground surface. The frame 122 can be considered as part of the dishwasher housing and may define a space that typically accommodates components of the dishwasher, such as a pump. The rear antenna 76 may be exposed, in that it is not covered by a panel of the dishwasher 10. The exemplary radio PCB 120 shown in FIG. 8 includes the rear antenna 76 as an on-board slot antenna and also includes an additional slot antenna 124; however, rather than employing the additional slot antenna 124, the cable 80 connects to the PCB 120 to override the additional slot antenna 124 such that the radio 78 uses the external front antenna 74 and the on-board rear antenna 76 rather than the two on-board antennas 76, 124. Other configurations are feasible wherein the PCB 120 is configured with only one on-board slot antenna (the rear antenna 76) and a connection to an external antenna (the front antenna 74). As another alternative, the rear antenna 76 need not be an on-board antenna but can be an external antenna coupled the radio 78, as in U.S. patent application Ser. No. 13/721,990, now U.S. Pat. No. 9,375,125, issued Jun. 28, 2016, which is incorporated herein by reference in its entirety.

Employing antenna diversity with the front and rear antennas 74, 76 and locating the upwardly facing front antenna 74 adjacent the user interface 28 on the upper face 30 of the closure element 20 (FIGS. 1 and 3) overcomes the challenge of providing wireless signal coverage around substantially the entire dishwasher 10 having the closure element 20 with the metallic front panel 22 that extends from at or near the upper edge 24 to at or near the lower edge 26 of the closure element 20 (i.e., the integrated closure element). The metallic front panel 22 essentially forms a large blind spot in front of the dishwasher 10 such that a single antenna cannot provide complete spherical antenna coverage around the dishwasher 10, but two strategically positioned antennas, the front and rear antennas 74, 76 are able to do so, as will be explained below in more detail.

In air, a slot antenna, which is used for the rear antenna 76 in the exemplary embodiment, has a 360° range of coverage, but the metallic front panel 22 and the tub 14, if metallic, interfere with signal transmission between the rear antenna 76 and areas in front of the dishwasher 10. The front antenna 74, positioned as disclosed herein, compensates for these areas of poor signal coverage. In air, a straight F-antenna, which is used for the front antenna 74 in the exemplary embodiment, has a 360° range of coverage, and this range is limited to around 180° when positioned at the upper face 30 of the closure element 20 because of the metallic front panel 22. An alternative antenna with a 180° range of coverage, such as an inverted F-antenna, could be employed for the front antenna 74 as long as it fits within the special constraints of the control console 90 and the closure element 20. In the illustrated embodiment, the straight F-antenna, which is smaller than the inverted F-antenna, is a better fit for the control console 90.

Figure 9:
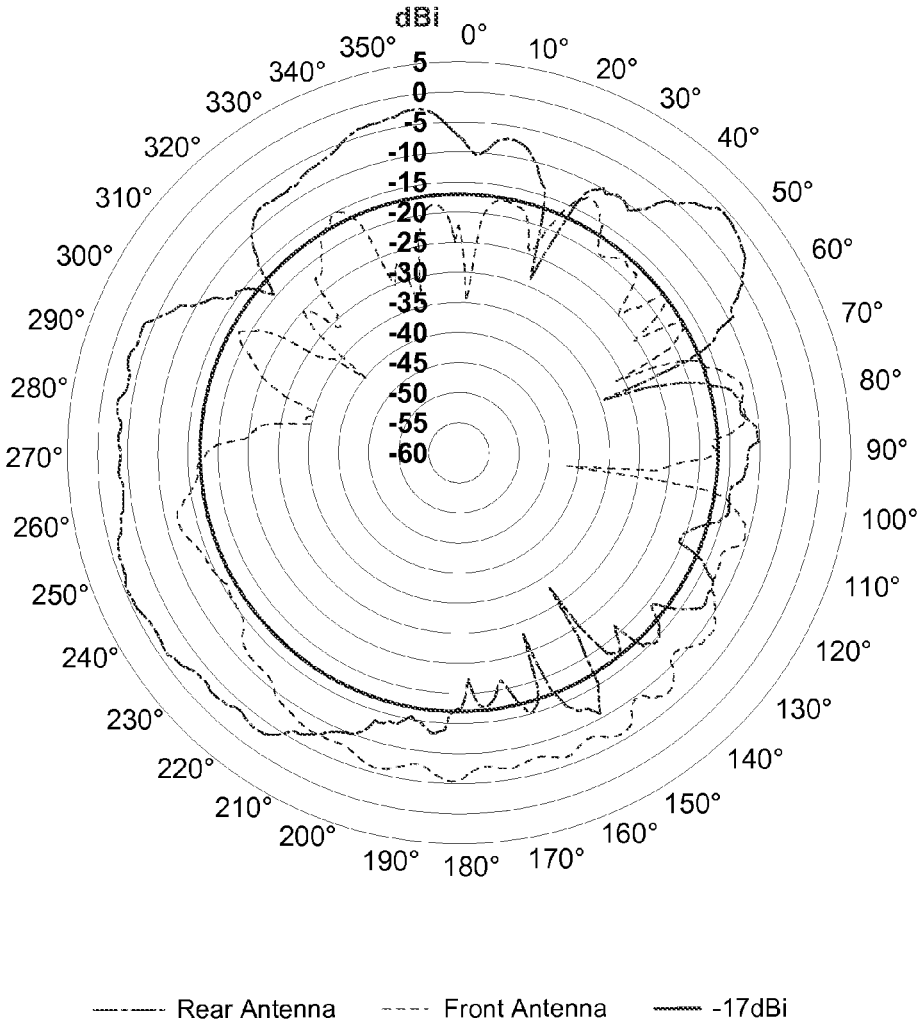
FIG. 9 is a polar graph illustrating antenna patterns for the front and rear antennas of the dishwasher of FIG. 3.

The combination of the front and rear antennas 74, 76, with their ranges of coverage affected by the metallic front panel 22 and the tub 14, if metallic, provides acceptable wireless signal coverage around the entire dishwasher 10. To illustrate this point, the polar graph of FIG. 9 presents results of performance testing of a dishwasher having the front and rear antennas 74, 76 of the embodiment of FIG. 3. The graph shows antenna patterns for the front and rear antennas 74, 76 along one plane of the dishwasher 10 and an "acceptable" ring of antenna strength (gain) of −17 dBi. A point on the graph corresponds to antenna strength (radial axis) at a certain position relative to the dishwasher (angular axis). Antenna performance increases (i.e., increase in gain) moving outward from the center of the graph, and the lower right hand quadrant and areas directly adjacent to this quadrant approximately correspond to positions in front of and above the dishwasher 10. Thus, the front antenna 74 has superior signal coverage in areas near the front and top of the dishwasher 10, while the rear antenna 76 performs better in the other areas around the dishwasher 10. It can be seen that at least one of the antennas 74, 76 has a strength of at least −17 dBi for nearly 360° around the dishwasher 10. Similar graphs for other planes of the dishwasher 10 reveal that the front and rear antennas 74, 76 positioned as described herein provide substantially spherical wireless signal coverage for the dishwasher 10. During operation, the communication module of the radio system with the radio 78 automatically scans the front and rear antennas 74, 76 at a regular time interval, such as once every second, to identify and select for use the antenna that has a stronger signal (i.e., highest gain).

Figure 10:
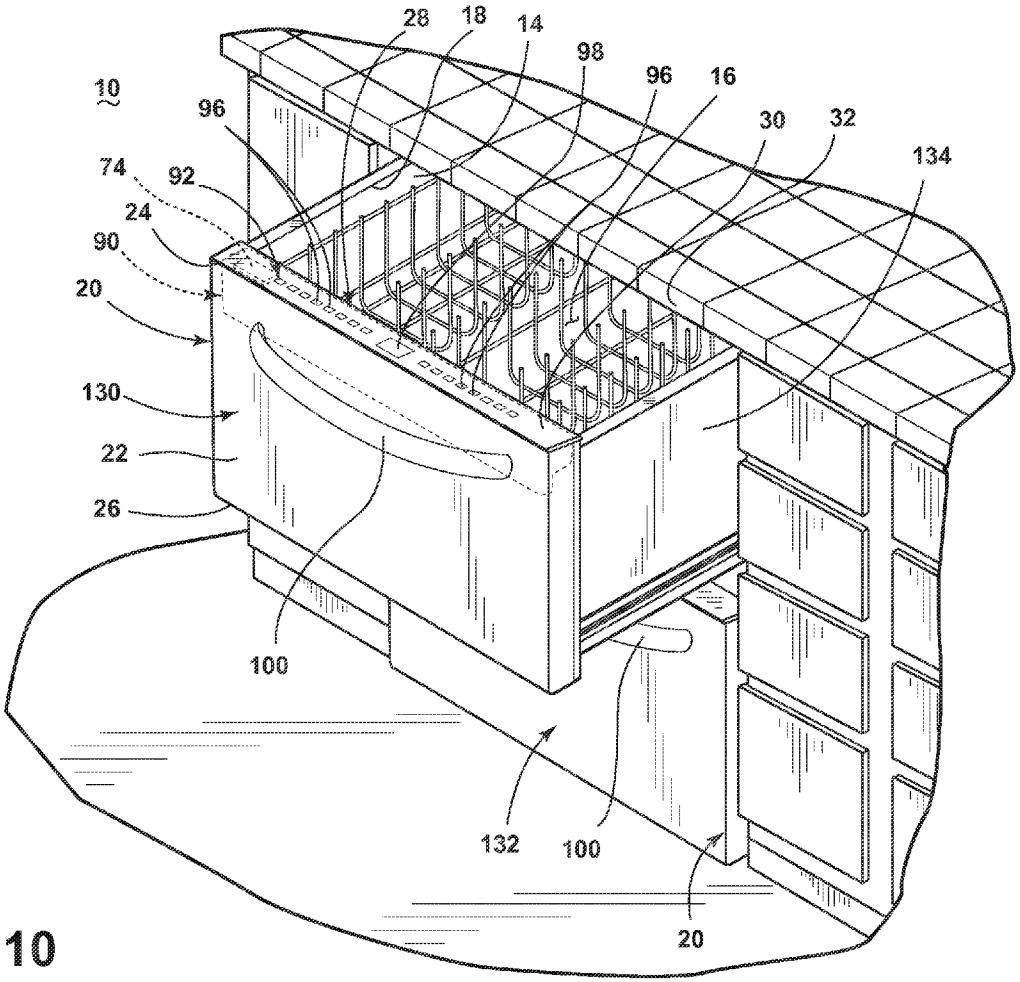
FIG. 10 is perspective view of a dishwasher, a drawer-type dishwasher, according to another embodiment of the invention, wherein an upper drawer with a closure element having a control console with a front antenna is in an opened position.
Figure 11:
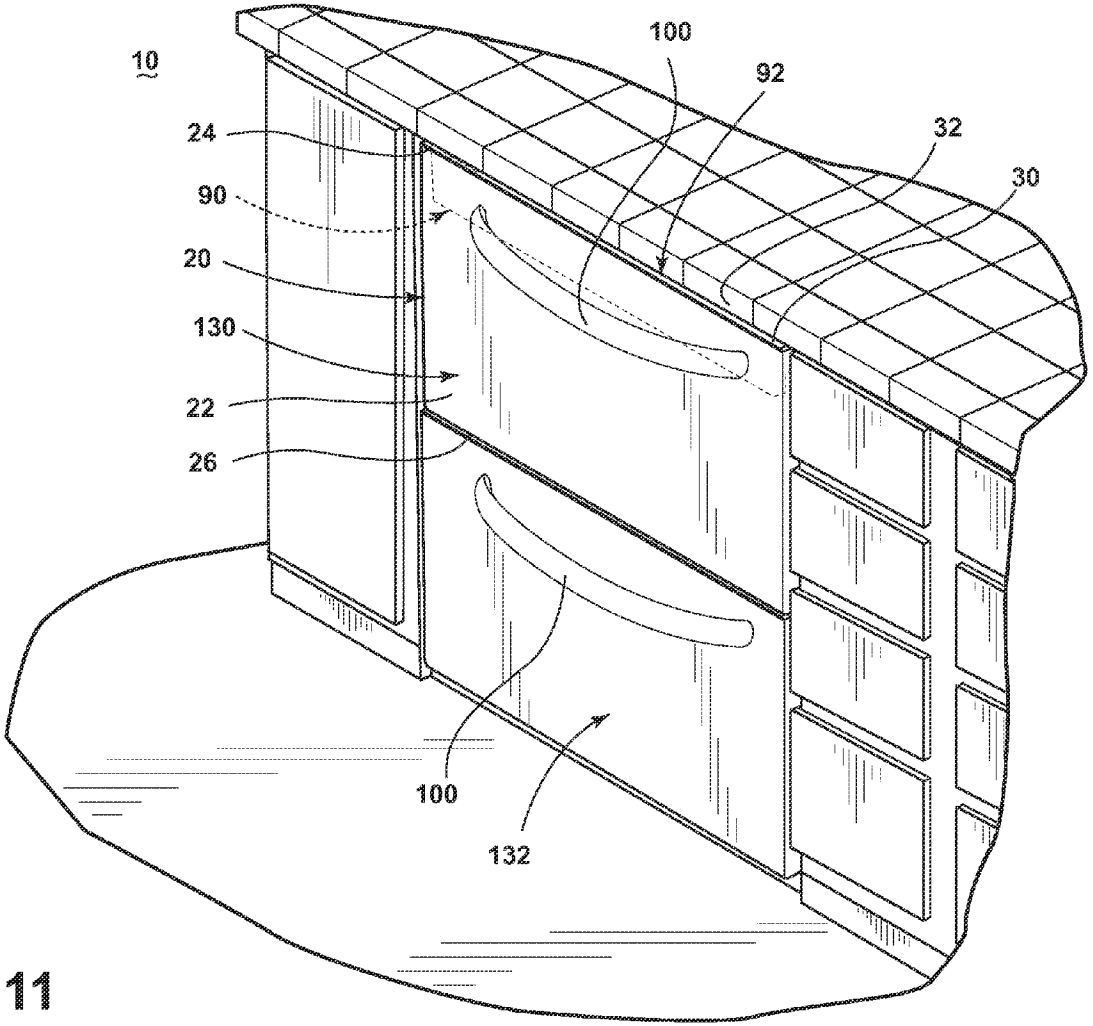
FIG. 11 is perspective view of the dishwasher of FIG. 10, wherein the upper drawer is in a closed position.

The radio system as described above can be modified for use in any of type of dishwasher or appliance having an upwardly facing user interface along an upper face of an integrated closure element. For example, FIGS. 10 and 11 illustrate a drawer-type dishwasher 10 having an upper drawer 130 and a lower drawer 132, with it being understood that the dishwasher 10 can have only one drawer or more than two drawers, or the drawers can be positioned side-by-side rather than one above the other. The dishwasher 10 can include many of the same elements disclosed for the embodiments shown in FIGS. 1-9, and like elements will be referred to with the same reference numerals for all embodiments. Referring to FIG. 10, at least one of the drawers, and illustrated by example as the upper drawer 130, has the closure element 20 with the metallic front panel 22 extending from at or near the upper edge 24 to at or near the lower edge 26 of the closure element 20 (i.e., integrated closure element) and the control console 90, as described for the embodiment of FIG. 3, mounted at an upper end of the closure element 20 behind the front panel 22. The control console 90 houses the front antenna 74, which faces upwardly adjacent the user interface 28 that forms the upper face 30 of the closure element 20. The dishwasher 10 also includes the rear antenna of the radio system as described for the previous embodiments but not shown in FIGS. 10 and 11.

Referring to FIG. 10, the upper drawer 130 includes the tub 14 slidable relative to the chassis (not shown) with treating chamber open face 18 facing upwardly, and the closure element 20 is slidable with the tub 14 as it forms at least a portion of a drawer housing 134 surrounding the tub 14 so that opening and closing the closure element 20 moves the tub 14 relative to the chassis. Sliding the closure element 20 and, thereby, the tub 14 forwardly to an opened position, as shown in FIG. 10, opens the treating chamber open face 18 and provides access to the treating chamber 16. When the closure element 20 is opened, the user interface 28 located on the upper face 30 of the closure element 20 is also accessible. When the closure element 20 of the upper drawer 130 slides to the closed position of FIG. 11, the tub 14 slides into the chassis, and the treating chamber open face 18 closes, thereby preventing access to the treating chamber 16. Additionally, the user interface 28 is inaccessible as the upper face 30 of the closure element 20 is positioned below the counter 32 or other similar surface. As with the previous embodiment, depending on the vertical spacing between the counter 32 and the upper face 30, a user may be able to touch a portion of the upper face 30, such as a front edge of the upper face 30, but, with the closure element 20 closed, the user cannot access the user interface 28 to fully interact with the user interface 28 (i.e., selecting buttons, viewing a display, etc.) as can be done when the closure element 20 is opened. The counter 32 physically blocks the user from the user interface 28, or at least a significant portion of the user interface 28, and renders the user interface 28 inaccessible.

As with the previous embodiments, the dishwasher 10 of FIGS. 10 and 11 includes the radio system having the front antenna 74, as just described, and the rear antenna (not shown) to provide acceptable wireless signal coverage around the entire dishwasher 10. Positioning the front antenna 74 adjacent the upwardly facing user interface 28 along the upper face 30 of the integrated closure element 20 provides coverage for areas in front of and above the dishwasher 10 that are not reached by the rear antenna due to being blocked by the metallic front panel 22 and the tub 14, if metallic.

One advantage that may be realized in the practice of the embodiments of the described systems and methods is that, even with an integrated closure element and a metal tub, the appliance has a complete antenna coverage pattern, such that the appliance can communicate with an external device, regardless of the location of the external device with respect to the appliance. Modifications may be made to the control console and the radio system, such as to accommodate a specific configuration of a dishwasher or to optimize the performance of the radio system. For example, the front antenna can be located within its own housing and/or it can be positioned adjacent the control console rather than being mounted within the control console as long as it is adjacent the upwardly facing user interface on the upper face of the closure element.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to at least one automatic cycle of operation, the dishwasher comprising:

a housing;

a tub at least partially defining an open-faced treating chamber within the housing for receiving dishes for treatment according to the at least one automatic cycle of operation;

a closure element movable to selectively close the open face of the treating chamber, the closure element including a metallic front panel extending from an upper edge of the closure element to a lower edge of the closure element and a control console located at an upper end of the closure element behind the front panel;

a user interface associated with the console and located on an upper face of the closure element such that when the closure element closes the open face of the treating chamber, the user interface faces upwardly and is inaccessible to a user; and an antenna located within the control console adjacent the user interface, wherein the antenna is adjacent the upper face of the closure element, wherein the antenna is directional and provides an upwardly-facing area of coverage when the closure element closes the open face of the treating chamber.

2. The dishwasher of claim 1 wherein the control console comprises a top plate forming the upper face of the closure element and a console body attached to the top plate, and the antenna is positioned between the top plate and the console body.

3. The dishwasher of claim 1, further comprising an additional antenna located on a side of the dishwasher opposite the closure element.

4. The dishwasher of claim 3 wherein the additional antenna is mounted at a lower rear side of the dishwasher.

5. The dishwasher of claim 3 wherein the antenna and the additional antenna form part of a radio system further comprising a communication module with a radio in communication with the antenna and the additional antenna.

6. The dishwasher of claim 5 wherein the additional antenna is an onboard PCB antenna in the communication module.

7. The dishwasher of claim 5 wherein the antenna is coupled to the radio with a cable extending through the closure element and to the side of the dishwasher opposite the closure element.

8. The dishwasher of claim 5 wherein the combination of the antenna and the additional antenna provide WiFi signal coverage of nearly 360 degrees around the dishwasher with a minimum signal strength of about −17 dBi.

9. The dishwasher of claim 1 wherein the tub is metallic.

10. The dishwasher of claim 3 wherein the additional antenna provides a second area of coverage, wherein the upwardly-facing area of coverage and the second area of coverage together provide complete spherical antenna coverage around the dishwasher.

* * * * *